United States Patent [19]

Boyce et al.

[11] 4,030,555

[45] June 21, 1977

[54] WIGGLE TABLE ELECTRONIC BALL GAME DEVICE

[76] Inventors: John G. Boyce; Richard G. Boyce, both of Box 249, Carlsbad, N. Mex. 88220

[22] Filed: Mar. 15, 1976

[21] Appl. No.: 666,939

[52] U.S. Cl. ..... 273/110; 273/121 A

[51] Int. Cl.[2] ..... A63F 7/16

[58] Field of Search ..... 273/110, 121 R, 121 A

[56] References Cited

UNITED STATES PATENTS

| | | | |
|---|---|---|---|
| 1,502,365 | 7/1924 | Wilson | 273/110 |
| 2,060,797 | 11/1936 | Chambers | 273/110 |
| 2,087,198 | 7/1937 | Chambers | 273/110 |
| 2,200,190 | 5/1940 | Plouvier | 273/110 X |
| 2,300,328 | 10/1942 | Wilsey | 273/110 |
| 2,562,126 | 7/1951 | Rishel | 273/110 |
| 2,658,755 | 11/1953 | Benak | 273/110 X |
| 2,791,428 | 5/1957 | McDonald | 273/110 |
| 3,236,522 | 2/1966 | Brown | 273/110 |
| 3,399,896 | 9/1968 | Burnside | 273/110 X |
| 3,452,987 | 7/1969 | DiMotta | 273/110 |
| 3,785,650 | 1/1974 | Halliburton | 273/110 |
| 3,815,917 | 6/1974 | Brown | 273/110 |
| 3,822,885 | 7/1974 | Domka et al. | 273/110 |

FOREIGN PATENTS OR APPLICATIONS

| | | | |
|---|---|---|---|
| 782,104 | 3/1935 | France | 273/110 |
| 1,384,503 | 11/1964 | France | 273/110 |
| 1,084,656 | 7/1954 | France | 273/110 |
| 6,605,498 | 10/1967 | Netherlands | 273/110 |

*Primary Examiner*—Richard J. Apley
*Attorney, Agent, or Firm*—Marcus L. Bates

[57] ABSTRACT

A game of skill device housed within a cabinet and pivotally supported by a vertical pedestal. A field of play is supported by the cabinet, and a coupling member enables the field of play to be tilted in any direction respective to the pedestal, so that the cabinet can be moved in any direction, thereby tilting the field of play and causing the ball to be gravitated in the direction of tilt. The field of play includes bumpers, lights, and electronic circuitry which enhances the game by the provision of background sounds and illuminated devices suitable to the action of the game.

12 Claims, 5 Drawing Figures

WIGGLE TABLE ELECTRONIC BALL GAME DEVICE

RELATED PRIOR ART

| | |
|---|---|
| Burnside | 3,399,896 |
| Brown | 3,236,522 |
| McDonald | 2,791,428 |
| Benak | 2,658,755 |
| Rishel | 2,562,126 |
| Wilsey | 2,300,328 |

The above cited prior art patents disclose various games of skill having a field of play supported in such a manner that the field can be tilted in one manner or another. Burnside tilts his machine along a horizontal axis; while Brown discloses a pivoted, pocketed game board, which can be tilted in any direction. McDonald houses his field of play within a cabinet so that the operator can impart a limited sidewise, vertical, and rocking movement about a pivot means which supports the head end of the game board. Benak, Rishel, and Wilsey disclose a shiftable or tiltable game board which is housed within an enclosure and manipulated by means of levers and linkage.

However, none of the prior art references teaches a game of skill device such as claimed and disclosed herein.

BACKGROUND OF THE INVENTION

The present invention is analogous in some respects to a pinball machine. Pinball machines have been developed into a complicated art. These prior art machines require a substantial amount of floor space, present a high profile, are extremely heavy, and therefore, are difficult to transport to the service shop. Most of the present pinball machines are extremely expensive in cost of manufacture, as well as requiring continuous maintenance.

Those persons addicted to playing pinball machines invariably attempt to operate the machine at its utmost limit, including jarring, moving, and otherwise influencing the travel of the ball about the field of play. Often a tilt device incorporated within the machine will end the game when undue force is exerted laterally or vertically thereon.

It would be desirable to provide a machine which encouraged the player to deliberately tilt the machine in an infinite number of directions in order to cause the ball to be gravitated in the direction of tilt. It would be desirable that such a machine have provisions by which the ball could not be gravitated when the game is not in play. Moreover, it would be desirable that the machine be almost indestructible so that when it is violently tilted or moved in a rotatable manner, a minimum of harm would result thereto.

Moreover, it would be desirable that such a machine be rendered essentially tamperproof and that the distribution of bumpers, lights, pop-bumpers, novelty switches, and the various background sounds associated therewith be arranged respective to the field of play in a manner to enhance the attractiveness thereof, thereby enabling the owner of the machine to attract a large number of players thereto.

It is furthermore desirable that such a ball game machine have any critical components thereof arranged in a readily accessible manner, so that when they can be removed and easily transported to the service shop where they can be disassembled and serviced as might be required.

SUMMARY OF THE INVENTION

An electronic ball game device for providing a game of skill comprising a cabinet upon which a field of play is supported, so that a ball freely supported upon the field of play is movable by gravity about the surfce thereof. A pedestal supports the cabinet by means of a resilient pivot which urges the field of play into a horizontal position, and which yieldingly resists movement of the field of play in any direction away from the horizontal position.

A stop means is interposed between the cabinet and the pedestal for limiting the distance that the field of play can be urged in any direction of tilt. A lock device is provided by which the field of play is locked into a fixed position, thereby preventing unauthorized play of the ball upon the field of play. A swivel means is interposed between the cabinet and the pedestal for enabling the field of play to be rotated axially about the pedestal.

The lock device includes electromagnets arranged to attract an armature, so that when the armature is in one of its alternate positions, the field of play can be tilted, and when the armature is in the remaining of the alternate positions, the field of play remains stationary respective to the pedestal.

Therefore, a primary object of the invention is the provision of a game of skill device having a field of play upon which a ball may be gravitated in any direction.

Another object of the invention is to provide a game of skill device having a tiltable field of play which incorporates limited stop means thereon, so that the degree of tilt, as well as the impact resulting therefrom, can be controlled.

A further object of this invention is to disclose and provide improvements in games of skill wherein a tiltable field of play is held in a locked position until use of the game device is authorized.

A still further object of this invention is the provision of apparatus for use in conjunction with a tiltable game of skill device which prevents unauthorized tampering therewith.

Another and still further object of the present invention is the provision of a new combintion which is embodied in a game structure having a tiltable field of play upon which a ball is supported and moved by gravitational forces in response to the field of play being tilted away from a horizontal position.

An additional object of the present invention is the provision of a game structure housed within a cabinet and supported by a pedestal which yieldingly resists movement by the player.

A still further object of the present invention is the provision of a tiltable game of skill apparatus which is normally yieldably urged to a neutral position in opposition to a force exerted by the player.

The above objects are attained by the provision of a game device made in accordance with the above abstract and summary.

These and various other objects and advantages oft he invention will become readily apparent to those skilled in the art upon reading the following detailed description and claims and by referring to the accompanying drawings.

DETAILED DESCRIPTION OF THE PREFERRED EMBODIMENT

Throughout the various figures of the drawings, wherever practical to do so, an effort has been exerted to cause like or similar numerals to refer to like or similar elements.

Figure 1:
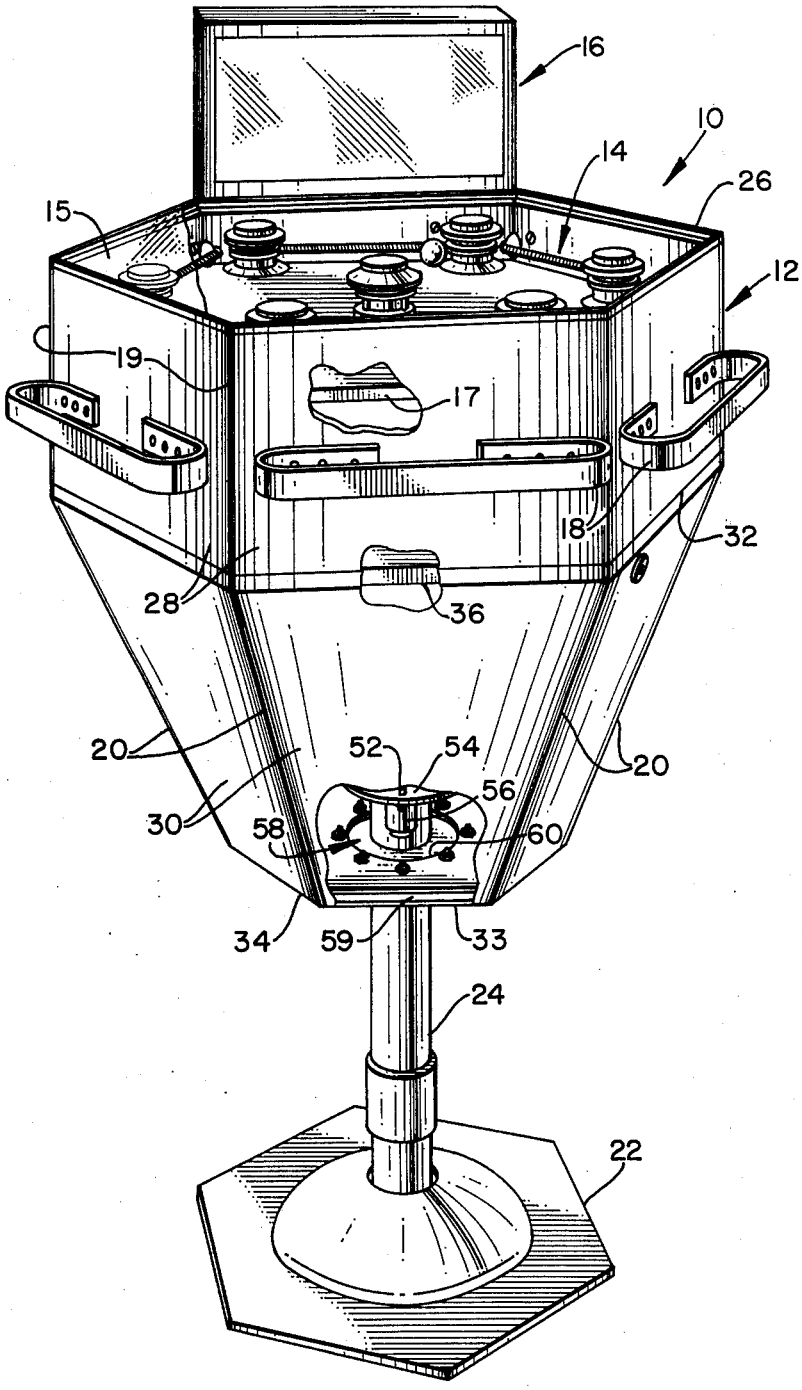
FIG. 1 is a front perspective view of a tiltable game device made in accordance with the present invention, with some parts thereof being cut away and removed therefrom in order to better illustrate the components contained therewithin.

In FIG. 1 of the drawings, there is disclosed a preferred embodiment of the present invention comprising a tiltable electronic ball game device broadly indicated by the numeral 10. The major components of the apparatus are housed within an upward opening cabinet 12, which presents a field of play 14, with the field of play underlying a glass cover 15 in the usual manner. A scoring panel 16 provides indicia related to the progress of the game. The field of play is supported by the cabinet structure and includes a horizontal planer member 17 attached by any convenient means to the outer shell forming the exterior of the cabinet. A plurality of handles 18 are affixed about the outer periphery of the machine cabinet at a convenient location thereto, and preferably are of a size and height to be conveniently grasped by one's hands.

The geometrical configuration of the device preferably presents radially spaced-apart corners 19 which downwardly converge at 20 to form the corners of an inverted truncated pyramid.

The cabinet is tiltable supported by a pedestal, with the pedestal comprised of a base 22 and an upright standard in the form of a vertically disposed metal tubing 24. Numeral 26 indicates an upper peripheral edge portion which defines the uppermost edge of the cabinet. The cabinet preferably is comprised of adjacent side panels 28, which adjoin one another at 19, thereby providing a hexagon of six equal sides. The lower side of each of the hexagons are joined to a triangular surface 30 in the form of an inverted truncated triangle. The truncated triangles are each joined together at opposed edge portions to form an inverted pyramid having six edges. Parting surface 32 enables the upper portion of the cabinet to be removed from the lower portion thereof so that the interior can be made easily accessible. A lowermost skirt displays an edge portion 34 which defines the lowermost periphery of the cabinet and terminates in the form of a base plate 33, with the latter being disposed parallel to members 17 and 36.

Member 36 provides a lower horizontal support means by which the weight of the entire cabinet and its attachments is transferred into the vertically disposed upright tubing.

Figure 2:
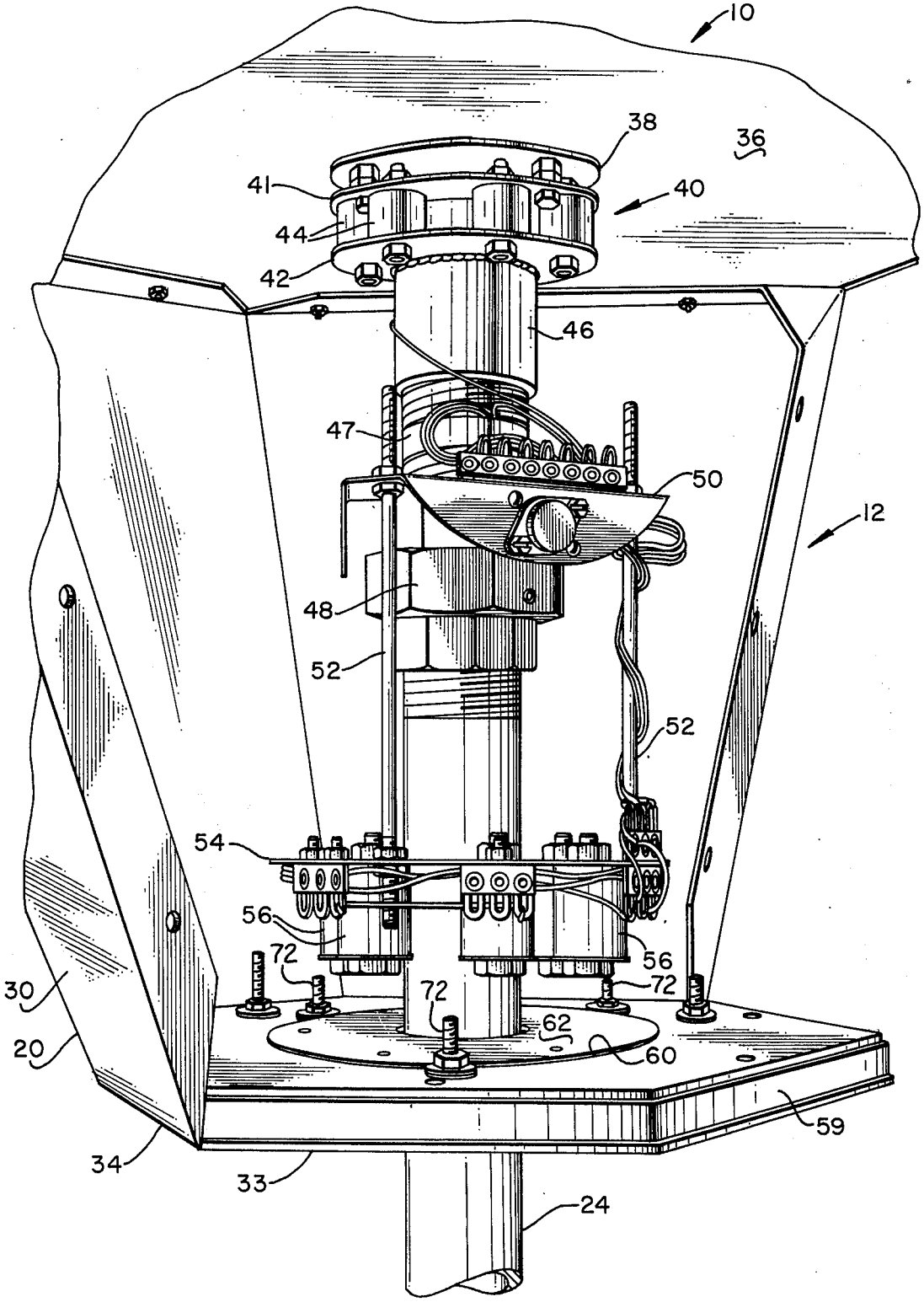
FIG. 2 is an enlarged, fragmentary, perspective view of part of the apparatus disclosed in FIG. 1.

As best seen illustrated in FIG. 2, in conjunction with some of the remaining figures, a load plate 38 is bolted onto the support member 36 and provides a means by which a resilient coupling means 40 can be interposed between the tubing and the cabinet. The resilient coupling comprises spaced-apart, superimposed, concentrically arranged, annular metallic disks 41 and 42, which are resiliently tied together by the illustrated radially spaced-apart rubberlike resilient supports 44, so that movement of plate member 41 away from the horizontal is resiliently yieldingly resisted as a marginal edge portion of one plate is forced towards an edge portion of the opposed plate. The mount plate 42 is attached to a coupling member 46, with the latter preferably being in the form of a piece of hollow, lightweight tubing of limited length. Tubing 47 affixed tubing 46 to a swivel means 48. The swivel means enables axial rotation between pedestal members 24 and 46 to be effected. The swivel means can be a pipe union which is not quite tightened completely, for example. The tubing 47 furthermore supports suspension plate 50, with the suspension plate being removably attached to the radially spaced-apart suspension bolts 52. The marginal lower end of the bolts are attached to a suspended plate 54; and accordingly, the last named plate is rigidly attached to member 52 and stands slightly free of the tubular member 24. A plurality of radially spaced-apart electromagnets 56 are mounted to plate 54 and are radially spaced from the tubing 24.

Figure 3:
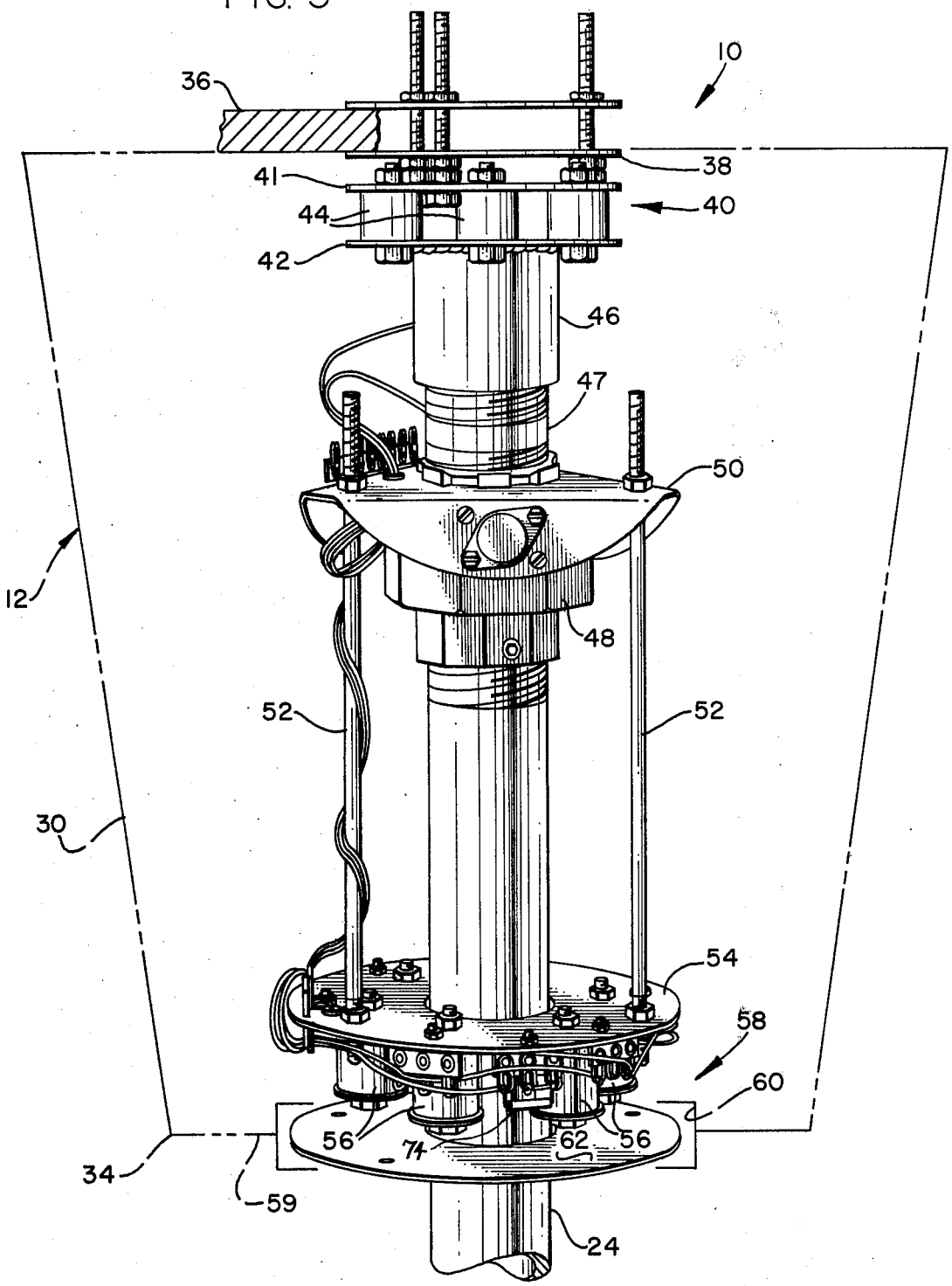
FIG. 3 is an isolated, fragmentary, part cross-sectional, part diagrammatical illustration of some of the components of the appartus disclosed in the foregoing figures.
Figure 4:
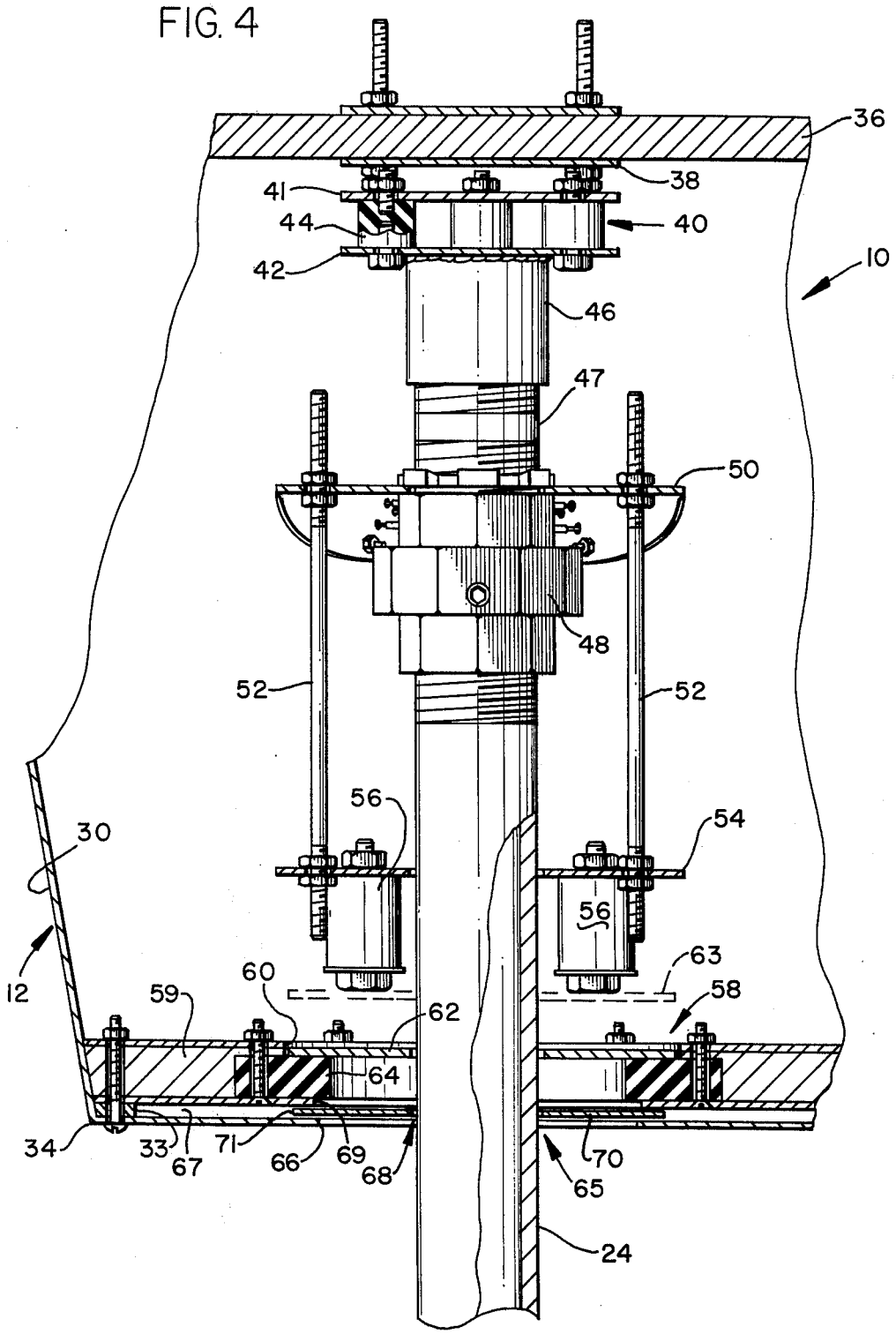
FIG. 4 is a fragmentary, part cross-sectional, elevational view of part of the apparatus disclosed in FIG. 3; and, FIG. 5 is a schematical representation of circuitry which forms part of the present invention.

As best seen illustrated in FIG. 4, in conjunction with FIGS. 2 and 3, the beforementioned electromagnets are seen to form part of a locking device which is generally indicated by the arrow at numeral 58. A lower closure member 59 is affixed to the inwardly turned lower peripheral edge portion of the skirt and provided with a circular cutout 60 within which there is received a locking plate 62 in close tolerance relationship therewith. The locking plate forms an armature respective to the electromagnets and is movable by magnetic attraction into the dot-dash position broadly indicated by the numeral 63.

The interior surface of the circular cutout is provided with the illustrated annulus within which a stop means, in the form of a rubber bumper of annular construction, is mountingly positioned. It should be noted in the embodiment of FIG. 4 that the rubber bumper, together with the lower closure member, form a circumferentially extending surface for bottom supporting the plate member 62 when the electromagnets are de-energized. In FIG. 2, however, the plate member 62 is captured between the thick washers 72.

Still looking at FIG. 4, there is seen disclosed therein apparatus 65, hereinafter called a tamper plate assembly, for preventing unauthorized entrance into the machine. The tamper plate assembly is comprised of annular plate having an i.d. 66. The plate is suitable bolted onto the lower closure member by utilizing a bolt circle having bolts placed therethrough for jointly holding the various members, including spacer 33, together. Annular cavity 67 underlies the stop means and is jointly formed by plate 66 and the adjacent spaced member. The tamper plate is spaced at 68 from the tubing 24 and moves therewith and in any direction towards the innermost edge portion 66 of the annular plate. The tamper plate is bottom supported by plate member 66, and is captured within the illustrated cavity 67. Hence the cutouts at 60 and 69 provide a plurality of functions respective to the overall combination of the cabinet, lower closure member, stop member, armature, and the tamper plate assembly.

A magnetically-actuated reed switch 74 is supported between two adjacent coils by means of a terminal strip so that when the armature is moved into the illustrated position noted by numeral 63, the resultant magnetic field causes the reed switch to be moved to an alternate position. This expedient provides a means by which a large voltage can initially be imposed on the electromagnets 56 in order to lift the plate 62 from its cavity. Thereafter the voltage is reduced to approximately 50% of its original value in order to continue to hold the armature adjacent to the energized electromagnets. The details of the circuitry for the electromagnets, as well as the various operational details of the circuitry used in conjunction with the invention, is best appreciated from studying FIG. 5.

Figure 5:
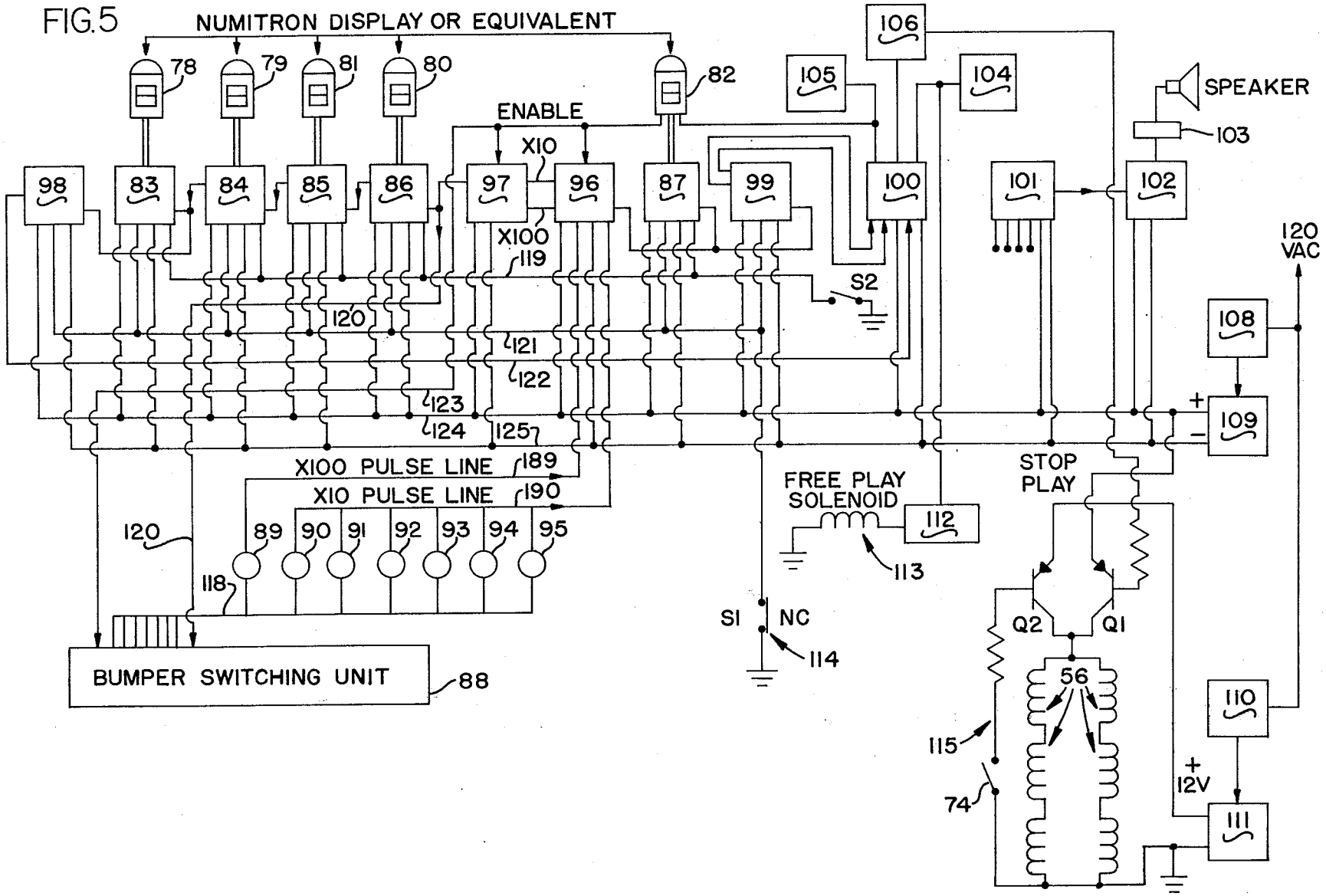

In the circuitry disclosed in FIG. 5 of the drawings, there is diagrammatically illustrated a numitron display comprised of members 78–82, with members 78–81 being connected respectively to decade counters 83–86. Decade counter 83 is the thousands counter, 84 is the hundreds counter, 85 is the tens counter, and 86 is the units counter. Decade counter 87 is the "out'-'counter.

A bumper switching unit 88 is connected to the illustrated pulse generating members 89–95, which in turn are connected to process the pulses received from members 89–95. Pulse multiplier 97 receives a pulse signal representative of either 10 or 100 pulses from the pulse processor 96 when the pulse processor is activated by one of the pulse members 89–95.

A numerical program 98 is adjustably set to providea free play program which is made dependent upon the final score contained within the numitron display window 78–81.

A numerical program 99 contains circuit means which determines the number of "outs"a player receives, and signals a machine program card 100 to instruct the player at the end of each game.

A sound effects synthesizer 101 is connected to an audio power amplifier 102 to provide suitable background noises for the illustrated speaker system. The audio portion of the circuitry is provided with a volume control 103.

Lamp display 104 instructs the player that he has at least one remaining play remaining in the apparatus. Lamp display 105 instructs the player that the machine is still in play and awaiting his next action. Lamp display 106 instructs the player that the game is over and that he needs to take the necessary action, such as inserting a coin into the coin slot, in order to activate the machine for further play.

A logic and segment power supply 108 is connected to a suitable supply of current and provides a 5 -volt regulated current at 109. A lamp and solenoid power supply 110 provides a 12 -volt supply at 111. Driver transistor 112 is connected to a solenoid 113, which resets switch 114 to commence a new game.

Circuitry 15 is comprised of transistors Q1 and Q2, along with the solenoids 56 previously seen disclosed in FIGS. 2 and 4. As seen at 115, the reed switch 74 is normally open and is moved to the closed position when solenoids 56 are energized, thereby reducing the current flow through the solenoids to approximately 50% of their initial load.

In operation, the apparatus is assembled and positioned clear of any surrounding vertical wall structure so that the player thereof can stand comfortably facing in any desired direction. A suitable source of current is provided for the mechanism, and the start switch 114 moved into the closed or conducting position to energize the circuitry. Upon startup, the player's score preferably is returned to zero, as evidenced by the lighted indicia provided by the score panel 16. After a suitable time delay of a few moments, the plate 62 is lifted into the position 63, thereby unlocking the device so that the field of play can be tilted in any desire direction. The few seconds delay which is incorporated between closure of the start switch and activation of the scoring circuitry, especially when a coin is utilized to actuate the starting switch, provides sufficient time for one to grasp the handles and position the ball upon the field of play wherever he may deem desirable.

Example of play: Each of the six corners of the field of play are provided with a sequentially lighted bumper having ten points in value if contacted by the ball when lighted. A central pop-bumper is included which, if lighted, provides 100 points when contacted by the ball. Suitable return springs and edge lighted material are provided about the field of play. The six radially spaced-apart bumpers are lighted in an indeterminate sequence. The central pop-bumper is first lighted, for example, and is followed by two bumpers being sequentially lit. When the lighted bumper is hit by the ball, the player receives a score count. Each time the ball contacts an unlighted bumper, the player receives one out. A programmed number of outs, for example 3, terminates the game. The play may be rewarded for attaining a predetermined high score by gratuitously playing the next game.

After the player has scored three outs, for example, the electromagnets 56 are de-energized, and the plate returned by gravity into the locked position, thereby precluding any unauthorized or free practice. The electronic scoring circuitry is also inhibited at this time.

Should one wish to practice with the machine, they may be inclined to insert an object at 65, thereby attempting to displace the plate 62 from its cavity in an effort to unlock the machine so that it may be tilted in various different directions. The tamper plate assembly at 65 discourages this undesirable action.

The machine is activated by the momentarily opening for switch 114. This action causes all of the counters and numerical program cards to be reset to zero, and the lamp display 105 to be illuminated. This action also sets a flip-flop circuit to energize the electromagnets 56 so that the before mentioned disk 62 is lifted from its cavity and the field of play is free to be tilted in any direction.

When the ball strikes one of the bumper switches 89–95, momentary switch closure provides a signal which is placed on one of the pulses lines, 189 or 190, leading to the pulse processor 96. The processor receives the signal and causes an output at either its X-10 or X-100 output terminal, dependent upon which bumper was struck by the ball. The pulse processor provides a signal to the pulse multiplier 97, where the circuitry produces either 10 or 100 distinct pulses. These pulses are treated by the decade counters where the result is tallied and displayed at 78–81.

The output of the pulse multiplier also provides a signal to the bumper switching unit 88, whereupon processing, an alternate bumper is randomly selected to be lighted, thereby becoming the only scoring bumper displayed on the field of play.

Should the player lose control of the ball and strike an unlighted bumper, a pulse signal is placed on the pulse line leading from the bumper 89–95 involved; whereupon, this particular pulse is received by the outs counter at 87 and a signal is sent to the outs program 99, where it is passed on to the input of the outs counter, where it is then counted and displayed as an out at 82. This same pulse also actuates the counter in the outs section of circuitry 87, where it is stored unitl sufficient out pulses have accumulated to reach a preprogrammed total of the card, whereupon the outs program card then produces an output that is passed to the machine program card 100, whereupon the flip-flops of the circuitry accomplish the following:

The play display lamp is turned off, the "game over'-'display lamp is illuminated, the "play again"display lamp is illuminated if it is appropriate to do so, and the circuitry at 56 is de-energized; thereby causing disk 62 to be gravitated into its cavity. At the same time, the bumper switching unit, pulse multiplier, and pulse processor are disabled by removal of voltage from the enable line 123.

The sound effects synthesizer 101 has the capability of generating musical sounds as well as the sound of sirens, clanking chains, the toll of bells, and various other sounds which may be tastefully associated with a game of this sort. The sound effects preferably are keyed on and off by the pulse output from the different counters, as well as from other more direct functions found within the machine of the present invention. Connecting to various ones of these recited terminals may be switched at random to produce the desired sound effects.

I claim:

1. A game of skill device comprising a cabinet, a field of play supported within said cabinet, a ball freely supported upon said field of play and movable by gravity upon the surface thereof;

a pedestal pivot means interposed between said cabinet and said means urging said field of play into a horizontal position and which yieldably resists movement in any direction away from a horizontal position;

a stop means for limiting the magnitude of angular displacement toward which said field of play can be urged in a direction away from a horizontal position;

and means forming a lock device by which said field of play can be locked into a fixed position respective to said pedestal whereby said field of play can no longer be tilted in a direction away from said locked position;

said lock device includes a magnetically actuated armature, means by which said armature is removably captured between said cabine and said pedestal at a location spaced from said pivot means in such a manner that relative movement therebetween can be effected only when the armature is displaced from captured relationship to said cabinet and pedestal.

2. The device of claim 1 wherein said pedestal includes a base from which there upwardly extends a vertical support member, said resilient pivot means being interposed between said support member and said cabinet;

a swivel means interposed between said cabinet and said pedestal for enabling said field of play to be rotated axially about said pedestal.

3. The device of claim 1 wherein said cabinet includes a downwardly converging skirt having a lower peripheral edge which encircles and is spaced from said pedestal;

said stop means being a resilient member interposed between said lower peripheral edge and said pedestal, said resilient member being affixed to said lower peripheral edge and spaced from said pedestal.

4. The device of claim 1 wherein said cabinet includes an upper member having a lower edge portion made in the form of a polygon from which there downwardly converges a skirt member made in the form of an inverted frustum of a pyramid; said field of play being arranged on an upper visible surface of said upper member; said upper member being affixed to said resilient pivot means; said pedestal having a lower base member from which there upwardly extends a tubular member, said resilient pivot means being affixed to said tubular member;

a swivel means interposed between said base and said upper member for enabling said cabinet to be rotated about the longitudinal central axis of said tubular member.

5. A game structure having a tiltable field of play upon which a ball is supported and moved by gravitonal force in response to said field of play being tilted away from a horizontal position; said game structure includes a cabinet, means supporting said field of play within said cabinet;

means forming a pedestal for supporting said field of play; means forming a resilient coupling, a stop means;

said resilient coupling being affixed to said pedestal, means by which said field of play is affixed to said resilient coupling such that said field of play yieldably resists movement as it is tilted in any direction away from the horizontal to thereby enable a ball supported on said field of play to be gravitated in any direction; said resilient coupled further including means urging said field of play into a horizontal position;

said stop means being arranged to limit the magnitude of displacement of said field of play away from a horizontal position;

a locking means connected to prevent said field of play from being moved relative to said pedestal;

a protective means for preventing access to said locking means; said protective means being a closure means which is captured between said pedestal and said cabinet.

6. The device of claim 5 wherein said lock device includes an electromagnet and an armature, said armature being movable towards and away from said electromagnet in response to energization thereof, means by which said armature is captured between said cabinet and said pedestal at a location spaced from said pivot means in such a manner that relative movement therebetween can be effected when the armature is displaced from captured relationship respective to said cabinet and pedestal.

7. The structure of claim 5 and further including swivel means interposed between said field of play and said pedestal such that said field of play and said predestal such that said field of play can be rotated axially respective to a line drawn normally thereto, while at the same time said field of play can be tilted.

8. The structure of claim 5 further including a cabinet within which said field of play is housed, wherein said cabinet has a downwardly converging, circumferentially extending skirt member, said skirt member having a lower, inwardly directed wall member spaced from said pedestal and positioned below said resilient coupling; and, a lock means interposed between said pedestal and said inwardly directed wall member.

9. A game structure having a tiltable field of play upon which a ball is supported and moved by gravitational force in response to said field of play being tilted away from a horizontal position;

said game structure includes a cabinet within which said field of play is housed;

means forming a pedestal for supporting said field of play; means forming a resilient coupling;

said resilient coupling being affixed to said pedestal, means by which said field of play is affixed to said resilient coupling such that said field of play yieldably resists movement as it is tilted in any direction away from the horizontal to thereby enable a ball supported on said field of play to be gravitated in any direction; said resilient coupling further including means urging said field of play into a horizontal position;

said cabint has a downwardly converging, circumferentially extending skirt member, said skirt member includes a lower, inwardly directed wall member spaced from said pedestal, and positioned below said resilient coupling to form part of a stop means; and, a lock means interposed between said pedestal and said inwardly directed wall member.

10. The structure of claim 9 and further including a protective means for preventing access to said locking means; said protective means being a closure means being a closure means which is captured between said pedestal and said cabinet.

11. The device of claim 9 wherein said lock device includes a locking plate; means forming a recess within a lower marginal edge of said skirt member, said locking plate being concentrically arranged respective to said recess and to said tubular member; said locking plate being of annular construction and being slidably received about said tubular member and removably received within said recess; and, means for moving said locking plate into and out of said recess.

12. A game of skill device comprising a cabinet, a field of play supported within said cabinet, a ball freely supported upon said field of play and movable by gravity upon the surface therof;

a pedestal, a resilient pivot means interposed between said cabinet and said pedestal means for urging said field of play into a horizontal position and which yieldably resists movement in any direction away from a horizontal position;

stop means affixed to said cabinet and spaced from said pedestal for limiting the magnitude of angular displacement toward which said field of play can be urged in a direction away from a horizontal position;

and means forming a lock device by which said cabinet is locked into a fixed position respective to said pedestal whereby said field of play can be no longer be tilted in a direction away from said locked position;

said cabinet includes an upper member having an upper visible surface and lower edge portion made in the form of a polygon from which there downwardly converge a skirt member made in the form of an inverted frustum of a pyramid; said field of play being arranged on an upper visible surface of said upper member; said upper member being affixed to said resilient pivot means; said pedestal having a lower base member from which there upwardly extends a vertical support member, said resilient pivot means being affixed to said vertical support member;

a swivel means interposed between said base and said upper member for enabling said cabinet to be rotated about the longitudinal central axis of said tubular member;

said lock device includes a locking plate; means forming a recess within a lower marginal edge of said skirt member, said locking plate being concentrically arranged respective to said being of annular construction and being slidably received about said vertical support member and removably received within said recess; and, means for moving said locking plate into and out of said recess.

* * * * *

UNITED STATES PATENT AND TRADEMARK OFFICE

CERTIFICATE OF CORRECTION

PATENT NO. : 4,030,555

DATED : JUNE 21, 1977

INVENTOR(S) : JOHN G. BOYCE and RICHARD G. BOYCE

It is certified that error appears in the above-identified patent and that said Letters Patent are hereby corrected as shown below:

Column 1, line 48, "encouraged" should read --encourages--.

Column 2, lines 11 and 54, "yieldingly" should read --yieldably--;

Lines 64 and 65, correct the spelling of --of the--.

Column 3, line 59, "edges" should read --sides--.

Column 4, line 13, insert --or yieldably-- for "yieldingly".

Column 5, line 30, after "connected", insert --to a pulse processor 96. The pulse processor is connected--;

Line 35, correct the spelling of "provide a";

Line 62, "15" should read --115--.

Column 6, line 48, "for" should read --of--.

Column 7, line 21, after "cavity" insert --The player can no longer gyrate the ball in any direction.--;

Line 33, "Connecting" should read --Connections--;

Line 41, after "pedestal," insert --a resilient--;

Line 42, after "said" (first occurrence), insert --pedestal,--;

Line 58, correct the spelling of "cabinet";

Line 62, after "relationship" insert --respective--.

UNITED STATES PATENT AND TRADEMARK OFFICE

CERTIFICATE OF CORRECTION

PATENT NO. : 4,030,555 Page 2 of 2

DATED : JUNE 21, 1977

INVENTOR(S) : JOHN G. BOYCE and RICHARD G. BOYCE

It is certified that error appears in the above-identified patent and that said Letters Patent are hereby corrected as shown below:

Column 8, line 29, correct the spelling of "gravitational";

Line 43, correct the spelling of "coupling";

Lines 67-68, delete "and said pedestal such that said field of play".

Column 9, lines 3-4, delete "further including a cabinet within which said field of play is housed";

Line 38, delete "being a closure means".

Column 10, line 23, after "and" insert --a--;

Line 25, "converge" should read --converges--;

Line 41, after "said" insert --recess and to said vertical support member; said locking plate--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*